United States Patent [19]

Buttner et al.

[11] Patent Number: 5,061,094

[45] Date of Patent: Oct. 29, 1991

[54] KEYBOARD FOR TYPEWRITERS, PRINTERS OR THE LIKE

[75] Inventors: Gunter Buttner; Friedrich Forschner, both of Nuremberg; Manfred Fuchtenkort, Allersberg; Rudolf Schmeykal, Hemhofen; Alfred Wieland, Ditzingen, all of Fed. Rep. of Germany

[73] Assignee: Ta Triumph-Alder AG, Nuremberg, Fed. Rep. of Germany

[21] Appl. No.: 629,949

[22] Filed: Dec. 19, 1990

[30] Foreign Application Priority Data

Dec. 22, 1989 [DE] Fed. Rep. of Germany ..... 3942597

[51] Int. Cl.[5] ..... B41J 5/08

[52] U.S. Cl. ..... 400/479; 400/491.2; 200/5 A; 200/512; 200/535

[58] Field of Search ..... 400/82, 472, 473, 474, 400/475, 479, 480, 481, 485, 486, 489, 490, 491, 491.1, 491.2, 495, 495.1; 200/5 A, 512, 517, 534, 535

[56] References Cited

U.S. PATENT DOCUMENTS

| | | | |
|---|---|---|---|
| 2,919,004 | 12/1959 | Henatsch | 400/473 |
| 3,749,872 | 7/1973 | Foster | 200/535 |
| 3,982,081 | 9/1976 | Demler, Jr. | 400/495 |
| 4,421,958 | 12/1983 | Kameda | 200/5 A |
| 4,480,932 | 11/1984 | Willcox | 400/485 |
| 4,480,937 | 11/1984 | Eckhardt | 400/491.2 |
| 4,529,849 | 7/1985 | Kamei et al. | 200/535 |

*Primary Examiner*—Edgar S. Burr
*Assistant Examiner*—Ren Yan
*Attorney, Agent, or Firm*—Browdy and Neimark

[57] ABSTRACT

In a keyboard for typewriters, printers or the like, where a contact bearing film is disposed underneath the keys, there is provided for achieving a cost-efficient arrangement, while avoiding the use of separate restoring springs, that the contact bearing film (10) has U-shaped cut-outs (11) in the area of the keys (1), the film tongues (12) are bent by 180° and are acted upon by the key tappet (3) of the keys (1), the contacts (14, 15) formed between the base of the film, the underside of the film tongue (12), and the film tongue (12) act at the same time as a restoring spring.

7 Claims, 1 Drawing Sheet

KEYBOARD FOR TYPEWRITERS, PRINTERS OR THE LIKE

FIELD OF INVENTION

The invention relates to a keyboard for typewriters, printers, input devices for data processing apparatus or the like, comprising a support plate, at least one film disposed on the support plate which is provided with printed contacts and strip conductors, and a guide arrangement connected to the support plate for a plurality of keys, such each key is provided with a key head and a key tappet in such a manner that the keys can be operated, guiding the keys vertically to the plane of the support plate, against a restoring force in the guide arrangement, the free end of the key tappet making contact with at least one contact on the film when being operated and returning to the original position.

BACKGROUND OF THE INVENTION

Conventional film keyboards are designed in such a way that they comprise an upper and a lower film with a spacing device, a so-called "spacer", placed between them, and wherein the films, which in the normal state are maintained at a distance from each other, are pressed together by the key tappet and thus make contact. In an alternative fashion it is also possible to use only a single film with strip conductors and fixed contacts, in which case the tappet works as a movable contact bridge.

With the first mentioned arrangement, the film combination is relatively expensive to manufacture. The disposition of switching contacts directly on the key tappet is also relatively expensive, as it requires separate restoring springs for the key tappets.

SUMMARY OF THE INVENTION

Based on the foregoing, it is an object of the invention to provide a keyboard at a reasonable cost and with assured functioning.

This object is attained in accordance with the invention by providing a single contact film which supports the strip conductors, the contacts and the switching contact; wherein the contact film, stamped out in the approximate shape of the letter U, forming a tongue, is located in the area underneath the key tappet; wherein the tongue is bent inwardly by approximately 180°, so that it comes to rest under the free end of the key tappet; and wherein the contacts and the switching contact are disposed in the areas of the bent film tongue or the flat film which face each other in this manner. In this way a second film is not needed, because the contacts and the switching contact can be provided on one and the same film. Added to this is the fact that, because of its inherent elasticity, the bent film tongue of a properly selected film has a restoring spring force, so that a separate restoring spring is not needed and the film tongues themselves take over this second function.

Thus, in accordance with the attainment of the objects of the present invention, it is necessary to print only one side of a single film, and the stamping process for stamping out the tongues can take place immediately following or at the same time. In this way expensive dual film arrangements with spacers are not needed and the assembly of the restoring springs is also avoided.

In a further embodiment of the invention, lateral cut-outs for adjusting the restoring force of the film tongues are provided in the transition area between the film tongue and film base. Accordingly, if the restoring force is too great, it can be reduced by intentional tapering of this bridge area.

In an advantageous way, the guide arrangements can be provided with support shoulders, where each support shoulder maintains one film tongue in its 180° bent position or presses it into this position. Thus the support shoulders are shaped as segments of a circle, for example, so that a defined bending of the film tongues and flush adherence to the support shoulder is achieved, the distance of the film tongue from the film base being practically determined by the radius of curvature of the support shoulder. Simultaneously this support shoulder is used as an assembling aid when the guide arrangement is connected with the support plate, i.e. when the film tongues are brought into position.

In an advantageous way an elastic transition area is furthermore formed between the key tappet and the key head. Because of this, elastic cushioning is provided when the end position has been attained during operation, i.e. when the free front end of the key tongue has brought the film tongue into contact with the film base.

The elastic transition area can be advantageously formed by an elastic, pin-like projection of the key tappet, whereby the key head is made of relatively hard plastic and the key tappet, made of relatively soft plasticor rubber, is molded to the key head in a two-component injection molding process. Use of elastic material reduces noise when thekey is actuated. Further, abrasion of the film is reduced as the use of an elastic pin reduces the surface pressure on the film when the key is actuated.

If in connection with some embodiments it should prove to be necessary or desirable, it is possible to dispose a helical spring between the key head and the key tappet in order to achieve a cushioned end contact of the key head.

BRIEF DESCRIPTION OF DRAWING

The invention will be described in detail below by means of a preferred embodiment in connection with the drawings.

DETAILED DESCRIPTION OF EMBODIMENT(S)

Figure 1:
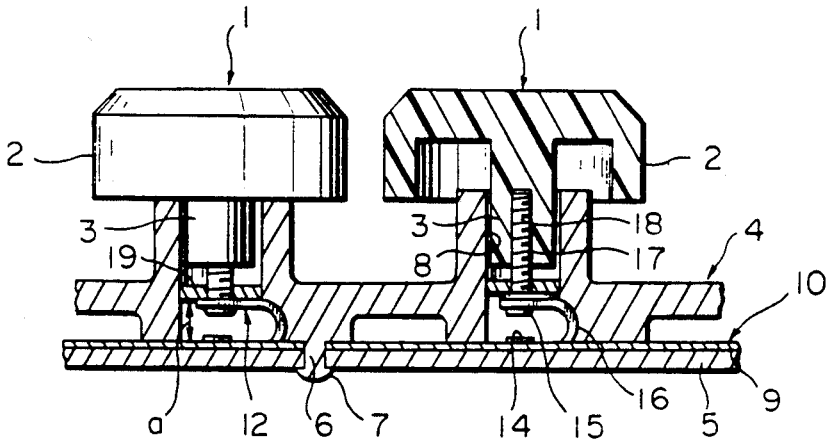
FIG. 1 is a sectional view of a keyboard in accordance with the invention.

A keyboard illustrated in FIG. 1 comprises a plurality of keys 1, each with a key head 2 and a key tappet 3. A guide arrangement 4, which is made of one piece for a plurality of keys 1 of the keyboard, is connected with a support plate 5 by means of pins 6, which are thickened at the ends 7. For each key 1, the guide arrangement 4 has a cylindrical guide bore 8, in each of which a key tappet 3 is guided movably in a direction vertically to the horizontal base plate 5.

A film 10, desirably formed of polyester of a thickness of 0.1 to 0.15 mm, is fastened to the top 9 of the support plate 5 and extends parallel to the support plate 5.

Figure 2:
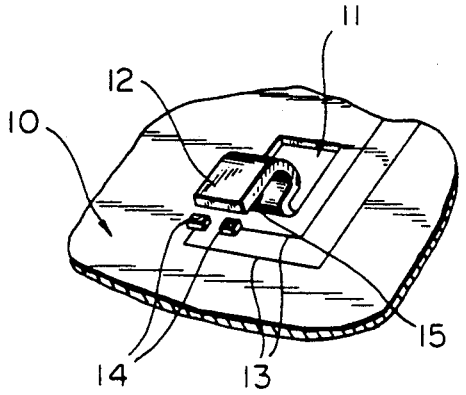
FIG. 2 is a perspective view to illustrate the structure of the film tongue of the contact film.

The film 10 is provided in the area of each key 1 with a cut-out 11 in the approximate shape of a letter U, which results in the creation of a free film tongue 12, which can be turned out of the base plane of the film by 180° and bent over, as illustrated in FIG. 2.

Strip conductors 13 and contacts 14 have been applied to the base film 10, for example by printing. On the side of the film tongue 12 facing the contacts, 14 a strip-shaped working contact 15, which bridges the two contacts 14 when it touches them, is provided.

The guide arrangement 4 has support shoulders 16 in the form of segments of a circle, through which the film tongues 12 are guided, bent at 180°, and the radius of curvature a/2 of which defines the distance a between the base of the film 10 and the film tongue 12.

A pin of a relatively elastic material is housed in a longitudinal bore !7 of the key tappet 3, which extends through plate-like projections 19 which are disposed on the guide arrangement 4 and transversely extend through the guide bores 18. The film tongue 12 rests against the undersides of the projections 19 as well as of the pin 18, the film tongue 12 pressing the key head 2 upwards via the pin 18 and the key tappet 3. The upper end position is defined by the curvature of the support shoulders or by the projections 19.

When actuating the keys 1, i.e. when pressure is applied to the key head 2, the working contact 15 on the underside of the film tongue 12 is pressed against the two switches 14 and connects them. When the pressure is released, a return into the initial position as shown in FIG. 1 is caused by the inherent elasticity of the film tongue 12, without separate springs being required.

In a variant of the example described, it is also possible that the guide arrangement 4 consists of individual modules, one or a plurality of keys being assigned to each module.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A keyboard for typewriters, printers, input devices for data processing apparatus or the like, comprising a support plate, a film disposed on the support plate having printed contacts and strip conductors thereon, and a guide arrangement connected with the support plate for a plurality of keys, each key being provided with a key head and a key tappet having a free end in such a way that the keys can be operated and guided vertically to the plane of the support plate, the free end of the key tappet making contact with at least one said contact when being operated, a tongue (12) stamped out of said contact carried by said film in an area underneath each said key tappet and bent inwardly by approximately 180° to assume an approximate U-shape, said bent tongue resting under the free end of each said key tappet (3), said contacts being disposed in the areas of the bent film tongue (12) and the film (10) which face each other.

2. A keyboard in accordance with claim 1, wherein said keys are operated against a restoring force and lateral cut-outs for adjusting the restoring force of the film tongues (12) are provided in a transition area between the film tongue (12) and film base.

3. A keyboard in accordance with claim 1, wherein the guide arrangements (4) have support shoulders (16), where each support shoulder (16) maintains one film tongue (12) in its position bent by 180° or presses it into this position.

4. A keyboard in accordance with claim 1, wherein an elastic transition area is formed by an elastic, pin-like projection (18) of the key tappet (3).

5. A keyboard in accordance with claim 1, wherein the key head (2) is made of relatively hard plastic and the key tappet (3), made of relatively soft plastic, is molded to the key head (2) in a two-component injection molding process.

6. A keyboard in accordance with claim 1 wherein said printed contacts comprise a first set of contacts (14) and a switching contact (15).

7. A keyboard in accordance with claim 1 wherein said guide arrangement is of one piece.

* * * * *